US012781974B2

(12) United States Patent
Teboulle

(10) Patent No.: US 12,781,974 B2
(45) Date of Patent: Nov. 3, 2026

(54) AUTOMATICALLY SWITCHING A COMBI RADIATOR

(71) Applicant: SAGEMCOM ENERGY & TELECOM SAS, Rueil Malmaison (FR)

(72) Inventor: Henri Teboulle, Rueil Malmaison (FR)

(73) Assignee: SAGEMCOM ENERGY & TELECOM SAS, Rueil Malmaison (FR)

( * ) Notice: Subject to any disclaimer, the term of this patent is extended or adjusted under 35 U.S.C. 154(b) by 0 days.

(21) Appl. No.: 18/486,742

(22) Filed: Oct. 13, 2023

(65) Prior Publication Data

US 2024/0133562 A1 Apr. 25, 2024

(30) Foreign Application Priority Data

Oct. 14, 2022 (FR) ..... FR2210636

(51) Int. Cl.
*F24D 9/00* (2022.01)
*F24D 13/04* (2006.01)
*F24D 19/10* (2006.01)

(52) U.S. Cl.
CPC ..... *F24D 9/00* (2013.01); *F24D 13/04* (2013.01); *F24D 19/1063* (2013.01); *F24D 19/1096* (2013.01)

(58) Field of Classification Search
CPC .. F24D 13/04; F24D 19/1018; F24D 19/1063; F24D 19/1096; F24D 2220/2036; F24D 9/00; F24H 15/277; F24H 15/31; F24H 15/37; F24H 15/421; F24H 3/0411; F24H 3/12
USPC ..... 392/307
See application file for complete search history.

(56) References Cited

U.S. PATENT DOCUMENTS

| | | | | |
|---|---|---|---|---|
| 2017/0059206 | A1* | 3/2017 | Lesage | F24H 15/45 |
| 2019/0212035 | A1* | 7/2019 | Knoeppel | F24H 15/175 |
| 2022/0364752 | A1* | 11/2022 | Levene | F24F 11/47 |

FOREIGN PATENT DOCUMENTS

| | | | |
|---|---|---|---|
| EP | 0617238 | A1 | 9/1994 |
| EP | 3067638 | A1 | 9/2016 |
| EP | 3421941 | A1 | 1/2019 |
| EP | 4 354 027 | B1 | 4/2024 |
| GB | 2 373 570 | * | 9/2002 |
| WO | WO8402765 | A1 | 7/1984 |

* cited by examiner

*Primary Examiner* — Sang Y Paik
(74) *Attorney, Agent, or Firm* — Muncy, Geissler, Olds & Lowe, P.C.

(57) ABSTRACT

A method of managing a combi radiator (1), the method comprising the following steps that are repeated for each current day, and for each current period taken from a predetermined set constituted by at least one successive period defined in the current day:
acquiring a predetermined indication from a predefined table (30), said predetermined indication being associated with said current period and being taken from a list comprising a first indication for which only the electrical radiator system (2) is to be activated, and/or a second indication for which only the hot-water radiator system (3) is to be activated, and/or a third indication for which both the electrical radiator system and the hot-water radiator system are to be activated;
controlling the radiator as a function of the predetermined indication.

11 Claims, 1 Drawing Sheet

AUTOMATICALLY SWITCHING A COMBI RADIATOR

DESCRIPTION

The invention relates to the field of smart meters and to communication gateways locally connected to such meters.

BACKGROUND OF THE INVENTION

Nowadays, so-called "smart" meters are progressively replacing conventional meters as used by distributors of electricity, water, and gas.

Naturally, the primary function of each such meter is measuring the quantity of electricity, water, or gas that the distribution network has supplied to the installation of an end user (or "subscriber"). These meters are also capable of performing a certain number of additional functions: receiving instructions to manage tariffs, remote meter reading and programming, customer information, etc.

Proposals have been to provide these meters with further functions by installing on customer premises a communication gateway (generally referred to as a "multi-utility gateway") that is connected to all of the meters of the installation. By way of example, such a gateway may be connected to the meters via the "wireless M-bus" protocol and to the information systems (IS) of the distribution system operators (DSOs) via a protocol such as NB-IoT, LTE-M, 2G, 3G, 4G, 5G, PLC, etc.

In this architecture, it is the gateway that reads the meters and sends the measurements to the ISes, and it is also the gateway that performs so-called "edge computing" operations (i.e. acting locally to process and analyze the measurements and other data produced by the meters).

In this context, new methods that are innovative and effective are being sought for reducing users' overall bills.

OBJECT OF THE INVENTION

An object of the invention is to reduce a user's overall energy bill.

SUMMARY OF THE INVENTION

In order to achieve this object, there is provided a management method for managing at least one combi radiator that comprises both an electrical radiator system and a hot-water radiator system, the electrical radiator system including an activation device enabling it to be activated and the hot-water radiator system including a valve arranged to act selectively to cut off a flow of water through the combi radiator;

the management method being performed by a processor unit including a memory storing a predefined table;

the management method comprising the following steps that are repeated for each current day, and for each current period taken from a predetermined period set constituted by at least one successive period defined in the current day, the steps comprising:

acquiring a predetermined indication from the predefined table, said predetermined indication being associated with said current period and being taken from a list comprising a first indication for which only the electrical radiator system is to be activated, and/or a second indication for which only the hot-water radiator system is to be activated, and/or a third indication for which both the electrical radiator system and the hot-water radiator system are to be activated;

controlling the activation device and/or the valve as a function of the predetermined indication.

The processor unit, which could for example be incorporated in a multi-utility gateway, thus acts on each current day to control the radiator systems of the combi radiator(s) as a function of the predetermined indications associated with the successive periods. The predetermined indications may be defined as a function of electricity tariffs and/or of tariffs for the energy used for heating the hot water (e.g. gas), thereby enabling the user's overall energy bill to be optimized.

There is also provided a management method as described above, wherein the processor unit keeps the valve open permanently, and wherein the list comprises only the second and third indications.

There is also provided a management method as described above, wherein the predetermined indication associated with said current period depends on said current period and/or on said current day and/or on the time of year applicable to said current day.

There is also provided a management method as described above, wherein the predetermined indications depend on electricity tariffs and/or on tariffs for energy used for heating the hot water.

There is also provided a management method as described above, wherein the predefined table can be modified remotely by an electricity DSO and/or by a DSO of energy for heating the hot water.

There is also provided a management method as described above, wherein, in order to modify the predefined table, the predetermined indications associated with the successive periods are transmitted to the processor unit by the electricity DSO and/or by the DSO of the energy for heating the hot water.

There is also provided a management method as described above, wherein, in order to modify the predefined table, the electricity tariffs and/or the tariffs of the energy for heating the hot water are transmitted to the processor unit by the electricity DSO and/or by the DSO of the energy for heating the hot water.

There is also provided a management method as described above, wherein, in order to modify the predefined table, input data enabling the processor unit to determine the electricity tariffs and/or the tariffs of the energy for heating the hot water are transmitted to the processor unit by the electricity DSO and/or by the DSO of the energy for heating the hot water.

There is also provided a management method as described above, wherein the predefined table can be modified locally by a user of the combi radiator(s).

There is also provided equipment comprising:

a first communication module arranged to communicate with at least one combi radiator;

a processor unit including a memory storing a predefined table, the processor unit being arranged to perform the management method as described above, the activation device and/or the valve being controlled via the first communication module.

There is also provided equipment as described above, further comprising a second communication module arranged in such a manner that the predefined table can be modified remotely via said second communication module by an electricity DSO and/or by a DSO of energy for heating the hot water.

There is also provided equipment as described above, further comprising a third communication module arranged in such a manner that the predefined table can be modified locally via said third communication module by a user of the combi radiator(s).

There is also provided equipment as described above, the equipment being a multi-utility gateway that is locally connected to an electricity meter and/or to a gas meter.

There is also provided equipment as described above, the equipment being a combi radiator.

There is also provided a computer program including instructions that cause the processor unit of the equipment as described above to execute the steps of the management method as described above.

There is also provided a computer-readable storage medium, storing the above-described computer program.

The invention can be better understood in the light of the following description of particular, nonlimiting embodiments of the invention.

BRIEF DESCRIPTION OF THE DRAWINGS

Reference is made to the accompanying drawings, in which:

FIG. 1 shows combi radiators, an electricity meter, a gas meter, and a multi-utility gateway;

FIG. 2 shows steps of a management method.

DETAILED DESCRIPTION OF THE INVENTION

Figure 1:
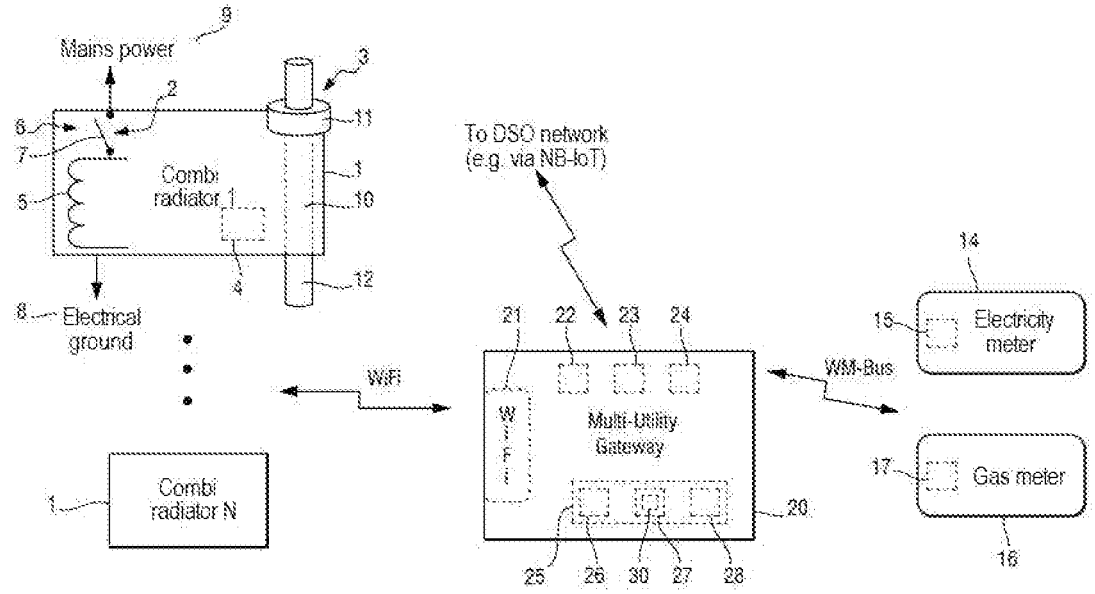
[FIG. 1]

With reference to FIG. 1, the user's home has installed therein at least one, and specifically a plurality of so-called "combi" radiators 1 (i.e. radiators that obtain heat from at least two different sources).

Each combi radiator 1 comprises an electrical radiator system 2, a hot-water radiator system 3, and a communication module 4.

The electrical radiator system 2 comprises a resistive heater element 5 and an activation system 6. The activation system 6 serves to activate the electrical radiator system 2, and in this example it comprises a switch 7 connected in series with the heater element 5.

The heater element 5 has a first terminal connected to electrical ground 8 (situated outside the radiator 1) and a second terminal connected to a first terminal of the switch 7. The switch 7 has a second terminal connected to a mains power supply 9 (situated outside the radiator 1).

In this example the communication module 4 is a Wi-Fi module. The communication module 4 enables the switch 7 to be controlled remotely to activate or de-activate the electrical radiator system 2. When the switch 7 is closed, an electric current flows through the heater element 5 and the electrical radiator system 2 produces heat. When the switch 7 is open, no electric current flows through the heater element 5 and the electrical radiator system 2 does not produce heat.

The hot-water radiator system 3 comprises an internal duct 10 and a valve 11.

The internal duct 10 runs through the combi radiator 1 and it is connected to a domestic hot water circuit 12. The valve 11 can be used selectively to cut off a flow of water through the internal duct 10 and thus through the combi radiator 1.

The communication module 4 also enables the valve 11 to be controlled remotely. When the valve 11 is open, hot water flows through the internal duct 10 and the hot-water radiator system 3 produces heat. When the valve 11 is closed, hot water does not flow through the internal duct 10 and the hot-water radiator system 3 does not produce heat.

The hot water is heated by a gas boiler; gas is thus the source of energy used in this example for heating the water.

It should be observed that the components of the combi radiators 1 that require electrical power (the communication modules 4, the valves 11, etc.) are preferably powered from the mains.

The electricity consumption of the user's home is measured by an electricity meter 14. The electricity meter 14 includes a communication module 15 suitable for communicating via the wireless M-bus (WM-bus) protocol.

The gas consumption of the user's home is measured by a gas meter 16. The gas meter 16 includes a communication module 17 suitable for communicating via the WM-bus protocol.

The electricity meter 14 and the gas meter 16 may be installed inside or outside the home.

A multi-utility gateway 20 that is specific to the home is installed inside or outside the home. The gateway 20 is locally connected to the electricity meter 14 and to the gas meter 16.

The gateway 20 includes first, second, third, and fourth communication modules 21, 22, 23, and 24.

The first communication module 21 is a Wi-Fi module.

The gateway 20 can thus act remotely to control the electrical radiator system 2 and the hot-water radiator system 3 of each combi radiator 1 via the first communication module 21 and the communication module 4 of said combi radiator 1.

The second communication module 22 serves to communicate via the narrowband internet of things (NB-IoT) protocol. The gateway 20 can thus communicate with electricity and gas distribution system operators (i.e. DSOs). In this specification, the abbreviation "DSO" is used to designate either the actual supplier of electricity or gas or else the manager of the electricity or gas distribution network, as applicable to the way the network in question is operated.

The third communication module 23 enables the user to communicate with the gateway 20. The third communication module 23 may comprise wireless means (near field communication (NFC), Wi-Fi, Bluetooth, etc.), or even wired means. It could also be an interface, e.g. one or more buttons and a screen located on the gateway 20.

The fourth communication module 24 serves to communicate via the WM-Bus protocol. The gateway 20 can thus communicate via the fourth communication module 24 both with the electricity meter 14 and its communication module 15 and also with the gas meter 16 and its communication module 17.

The gateway 20 also incorporates a processor module 25. The processor unit 25 comprises at least one (electronic and/or software) processor component 26, which, by way of example, may be a general-purpose processor, a processor specialized in signal processing (known as a digital signal processor (DSP)), a microcontroller, or indeed a programmable logic circuit such as a field programmable gate array (FPGA) or an application-specific integrated circuit (ASIC). The processor unit 25 also comprises one or more memories 27 connected to or integrated in the processor component 26. At least one of the memories 27 forms a computer-readable medium storing at least one computer program including instructions enabling the processor component 26 to execute at least some of the steps of the management method that is described below.

The processor unit 25 also comprises a real time clock (RTC) 28.

There follows a description of the management method used for managing the combi radiators 1 of the home, which method is performed in this example by the processor unit 25 of the gateway 20.

The purpose of the management method is to reduce the user's overall bill for both gas and electricity by switching the consumption of the combi radiators 1 from gas to electricity, and from electricity to gas, at certain relevant moments.

In this example, the management method is run at the initiative of the user. This is not essential, and the management method could be run at the initiative of one of the gas and electricity DSOs, or indeed automatically.

When the radiators 1 are ON and the method is active, each current day is taken to comprise a predetermined period set of at least one successive period Pk, where k lies in the range 1 to N.

Each period Pk has a respective duration Hk, and thus for each current day:

$$\sum_{k=1}^{N} Hk = 24 \text{ hours}$$

The durations Hk of these periods Pk need not necessarily be identical.

The combi radiators 1 are controlled, i.e. their use of electricity and of hot water (heated by gas) is switched ON and OFF, on a period-by-period basis (i.e. not on a daily basis, unless the current day has only one period).

For each current day and for each current period, the management method consists in acquiring, from a predefined table 30, a predetermined indication associated with said current period, and in controlling the activation device 6 of the electrical radiator system 2 and/or the valve 11 of the hot-water radiator system 3 as a function of the predetermined indication.

The predetermined indication is taken from a list comprising a first indication for activating only the electrical radiator system 2, and/or a second indication for activating only the hot-water radiator system 3, and/or a third indication for activating both the electrical radiator system 2 and the hot-water radiator system 3.

The predefined table 30 is stored in a memory 27 of the processor unit 25.

The predetermined indication that is associated with each current period may depend on said current period and/or on said current day and/or on the time of year applicable to said current day.

In this example, the predetermined indications depend on the gas and electricity tariffs applicable to each successive period, which tariffs thus depend, for each current day, on said successive periods of said current day and/or on said current day and/or on the time of year applicable to said current day.

Equivalent energy consumption in kilowatt-hours (kWh) is thus optimized by automatically switching the mode of operation of the combi meters 1 either to hot water or to electricity or to both as a function of the tariffs applied during each daily period (N tariff periods per day).

The predefined table 30 can be modified remotely by the electricity DSO and/or by the gas DSO. The DSO(s) communicate with the gateway 20 via the second communication module 22. This makes it possible to take account of changes in tariffs as they occur.

In one implementation, in order to modify the predefined table 30, the electricity and/or gas DSO transmits the predetermined indications associated with the successive periods directly to the processor unit 25 of the gateway 20 via its second communication module 22. The processor unit 25 thus receives directly the information making up the predefined table 30.

In another implementation, in order to modify the predefined table 30, the electricity and/or gas DSO transmits the electricity and/or gas tariffs to the processor unit 25 via the second communication module 22. As mentioned above, these tariffs might vary as a function of the day and of the period. For each current day, the processor unit 25 uses these tariffs to produce the predetermined indications associated with the successive periods of said current day.

In another implementation, in order to modify the predefined table 30, the electricity and/or gas DSO transmits input data to the processor unit 25 via the second communication module 22, which input data enables the processor unit 25 to determine the electricity and/or gas tariffs. The processor unit 25 then determines the tariffs from the input data, and for each current day it uses the tariffs to produce the predetermined indications associated with the successive periods of said current day.

The tariffs can thus depend on the type of the day (weekday, week-end, bank holiday, vacation), and the DSO(s) (or the processor unit 25 using the data transmitted by the DSO(s)) can thus update the predefined table 30 regularly, e.g. every day.

The clock 28, which is re-set regularly by one or more DSOs (via the second communication module 22), serves to manage the calendar of tariffs associated with the predefined table 30.

The predefined table 30 can also be modified by the user. The user communicates with the gateway 20 via its third communication module 23.

There follows an example of a predefined table:

| Period | Predetermined indications | Preferential tariff |
|---|---|---|
| 1 | Second indication | Gas |
| 2 | First indication | Electricity |
| . . . | First indication | Electricity |
| k | First indication | Electricity |
| . . . | Second indication | Gas |
| N-1 | Second indication | Gas |
| N | First indication | Electricity |

In this example the predetermined indications comprise the first and second indications.

It can be seen that the predetermined indications associated with the successive periods do indeed depend on the electricity and gas tariffs.

For periods 2 to k (included) and for period N, the preferential tariff is the electricity tariff, and the predetermined indication associated with each of these period is the first indication: only the electrical radiator system 2 is to be activated.

For the other periods, the preferential tariff is the gas tariff, and the predetermined indication associated with each of these periods is the second indication: only the hot-water radiator system 3 is to be activated.

Figure 2:
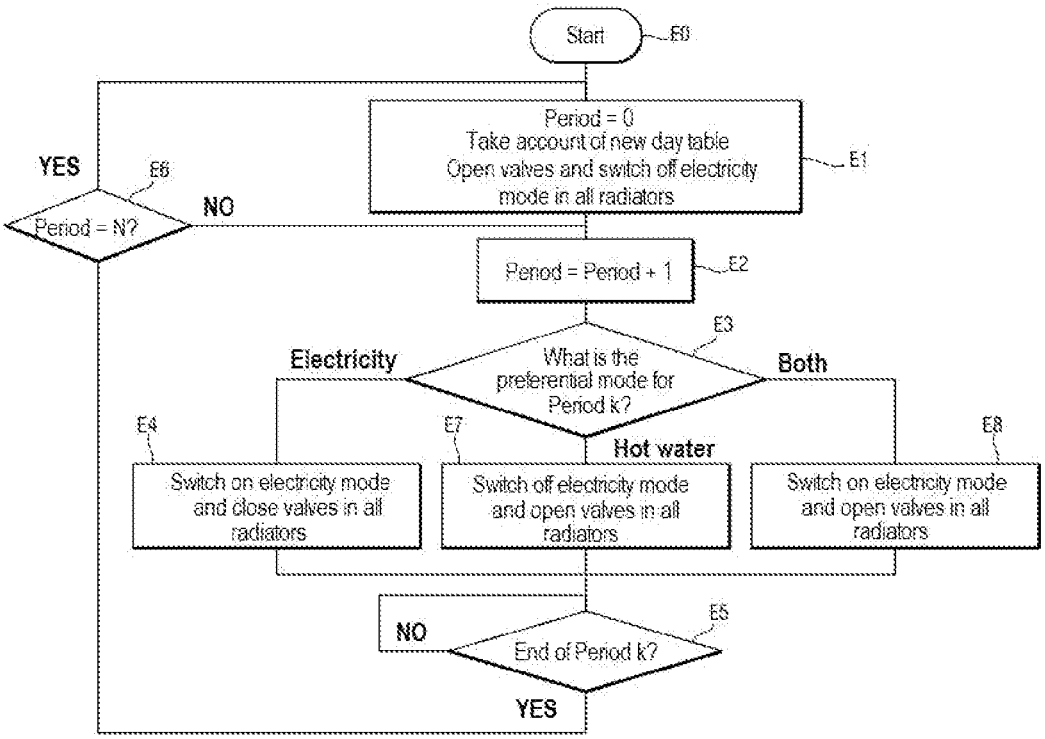
[FIG. 2]

With reference to FIG. 2, there follows a description of the management method.

The method begins with step E0.

Thereafter, a variable, written "Period", is initialized to 0.

The processor unit 25 takes account of a new predefined table 30, which has been updated. In this implementation, the processor unit 25 updates the predefined table 30 every day on the basis of information transmitted by the electricity and gas DSOs.

The processor unit 25 opens the valve 11 and de-activates the electrical radiator system 2 in each combi radiator 1 (step E1).

The processor unit 25 increments the Period variable:

Period=Period+1 (step E2).

The processor unit 25 inspects the predetermined indication associated with the current period (step E3).

If the predetermined indication is the first indication, the processor unit 25 activates the electrical radiator system 2 of each combi radiator 1, and closes the valve 11 of each combi radiator 1 (step E4).

The processor unit 25 then checks whether the present time corresponds to the end of the current period (step E5).

If not, the method loops back to step E5.

If so, the processor unit 25 checks whether the current period is the last period of the current day, i.e. whether:

Period=N (step E6).

If so, the method moves on to step E1. If not, the method moves on to step E2.

In step E3, if the predetermined indication is the second indication, the processor unit 25 de-activates the electrical radiator system 2 of each combi radiator 1, and opens the valve 11 of each combi radiator 1 (step E7). The method then moves on to step E5.

In step E3, if the predetermined indication is the third indication, the processor unit 25 de-activates the electrical radiator system 3 of each combi radiator 1, and also opens the valve 11 of each combi radiator 1 (step E8). The method then moves on to step E5.

Alternatively, it is possible to make provision for the processor unit 25 to keep the valve 11 of the hot-water radiator system 3 permanently open in each of said combi radiators 1. Under such circumstances, the hot-water radiator system 3 is always active (at least while the management method is active), and the list of predetermined indications comprises only the second indication (for which only the hot-water radiator system 3 is to be activated) and the third activation (for which both the electrical radiator system 2 and the hot-water radiator system 3 are to be activated). The processor unit 25 thus controls only opening and closing of the switch 7 in each combi radiator 1. Step E4 in FIG. 2 is omitted.

It should be observed that it is highly advantageous to implement the management method in the multi-utility gateway. Specifically, such a gateway is designed not only to communicate with the DSOs and thus acquire tariff information, but also to communicate locally with equipment in the home, such that implementing the invention in the gateway does not require new communication means to be incorporated therein.

Naturally, the invention is not limited to the implementations described, but covers any variant coming within the ambit of the invention as defined by the claims.

The gateway could communicate with the radiators, the meters, and the DSOs using communication means other than those described above. Various different means suitable for communicating with the DSOs are already mentioned above. By way of example, communication with the radiators could make use of the Zigbee or KNX (or "Konnex") protocols. By way of example, communication with the electricity meter could make use of power-line 35 communication (PLC), M-Bus, or serial high-level data link control (HDLG).

The multi-utility gateway could be incorporated in the electricity meter.

The equipment incorporating the processor unit in which the management method is performed, need not necessarily be a multi-utility gateway, and it could be some other piece of equipment, e.g. one of the combi radiators. The invention could equally well be performed in one of the meters or in a data concentrator connected to meters in a plurality of homes or to a plurality of gateways. The invention could also be performed remotely, in the premises of a DSO, who would then control the combi radiators remotely, or indeed the method could be performed in the "cloud".

The user's home where the invention is performed need not necessarily have combi radiators only, but could have at least one combi radiator together with one or more hot-water (only) radiators and/or one or more electrical (only) radiators.

The hot water flowing through the internal ducts of the hot-water radiator systems of the combi radiators need not be heated by a gas boiler, but could be heated by other heater means using some other energy source: oil, wood (logs, pellets), etc. Under such circumstances, the predetermined indications could depend solely on electricity tariffs, or possibly solely on the tariffs for the energy for heating the hot water. The predefined table could then optionally also be modified by the DSO of the energy used for heating the water.

The list of predetermined indications need not necessarily comprise the first indication, the second indication, and the third indication, but could comprise only some of these indications, or indeed other indications, e.g. an indication for de-activating both radiator systems when the tariffs are too high at certain periods of the day (e.g. at night). Provision may be made for such an indication to be selected only by the user (and not by the DSOs).

The invention claimed is:

1. A management method for managing at least one combi radiator that comprises both an electrical radiator system and a hot-water radiator system, the hot-water radiator system including a valve arranged to act selectively to cut off a flow of water through the at least one combi radiator;

the management method being performed by a processor unit including a memory storing a predefined table, the processor unit being incorporated in the at least one combi radiator or being locally connected to the at least one combi radiator, the processor receiving electricity and/or gas tariffs that are transmitted from an electricity distribution system operator and/or a distribution system operator of energy for heating the hot water;

the management method comprising the following steps that are repeated for each current day, and for each current period taken from a predetermined period set constituted by at least one successive period defined in the current day, the steps comprising:

acquiring a predetermined indication from the predefined table, said predetermined indication being associated with said current period and being taken from a list comprising a first indication for which only the electrical radiator system is to be activated, and/or a second indication for which only the hot-water radiator system is to be activated, and/or a third indication for which both the electrical radiator system and the hot-water radiator system are to be activated;

controlling an activation of the electrical radiator system and/or the valve as a function of the predetermined indication; and using the electricity and/or gas tariffs to produce the predetermined indications associated with the successive periods of said current day.

2. The management method according to claim 1, wherein the processor unit keeps the valve open permanently, and wherein the list comprises only the second and third indications.

3. The management method according to claim 1, wherein the predetermined indication associated with said current period depends on said current period and/or on said current day and/or on the time of year applicable to said current day.

4. The management method according to claim 1, wherein the predefined table can be modified remotely by the electricity distribution system operator and/or by the distribution system operator of energy for heating the hot water.

5. The management method according to claim 1, wherein the predefined table can be modified locally by a user of the at least one combi radiator.

6. Equipment comprising:

a first communication module arranged to communicate with at least one combi radiator; and a processor unit including a memory storing a predefined table, the processor unit being arranged to perform the management method according to any preceding claim, the activation of the electrical radiator system and/or the valve being controlled via the first communication module.

7. The equipment according to claim 6, further comprising a second communication module arranged in such a manner that the predefined table can be modified remotely via said second communication module by an electricity distribution system operator and/or by a distribution system operator of energy for heating the hot water.

8. The equipment according to claim 6, further comprising a third communication module arranged in such a manner that the predefined table can be modified locally via said third communication module by a user of the combi radiator(s).

9. The equipment according to claim 6, the equipment being a multi-utility gateway that is locally connected to an electricity meter and/or to a gas meter.

10. The equipment according to claim 6, the equipment being a combi radiator.

11. A non-transitory computer-readable storage medium storing a computer program including instructions that cause the processor unit of the equipment according to claim 10 to execute steps of a management method, wherein the management method manages at least one combi radiator comprising both an electrical radiator system and a hot-water radiator system, the hot-water radiator system comprising a valve arranged to act selectively to cut off a flow of water through the at least one combi radiator;

the management method is performed by the processor unit, the processor unit being incorporated in the at least one combi radiator or being locally connected to the at least one combi radiator, the processor receiving electricity and/or gas tariffs that are transmitted from an electricity distribution system operator and/or a distribution system operator of energy for heating the hot water;

the management method comprises the following steps that are repeated for each current day, and for each current period taken from a predetermined period set constituted by at least one successive period defined in the current day, the steps comprising:

acquiring a predetermined indication from the predefined table, said predetermined indication being associated with said current period and being taken from a list comprising a first indication for which only the electrical radiator system is to be activated, and/or a second indication for which only the hot-water radiator system is to be activated, and/or a third indication for which both the electrical radiator system and the hot-water radiator system are to be activated;

controlling anthe activation of the electrical radiator system and/or the valve as a function of the predetermined indication; and using the electricity and/or gas tariffs to produce the predetermined indications associated with the successive periods of said current day.

* * * * *